United States Patent [19]

Schroeder et al.

[11] Patent Number: 4,900,458

[45] Date of Patent: Feb. 13, 1990

[54] POLYALKYLENEPOLYAMINES AS CORROSION INHIBITORS

[75] Inventors: Albert H. Schroeder, Richmond; Ta Y. Ching, Novato; Shigeto Suzuki, San Francisco; Kiyoshi Katsumoto, El Cerrito, all of Calif.

[73] Assignee: Chevron Research Company, San Francisco, Calif.

[21] Appl. No.: 142,612

[22] Filed: Jan. 11, 1988

Related U.S. Application Data

[63] Continuation-in-part of Ser. No. 1,929, Jan. 8, 1987, abandoned.

[51] Int. Cl.[4] ..... E21B 41/02; C23F 11/04

[52] U.S. Cl. ..... 252/8.555; 252/390; 422/12; 564/482; 564/511; 564/512

[58] Field of Search ..... 252/8.555, 390, 392; 422/12; 564/482, 511, 512

[56] References Cited

U.S. PATENT DOCUMENTS

| | | | |
|---|---|---|---|
| 2,736,658 | 2/1956 | Pfohl | 564/511 X |
| 3,260,669 | 7/1966 | Schoen | 252/8.555 |
| 3,565,941 | 2/1971 | Dick et al. | 260/465.5 |
| 4,279,621 | 7/1981 | Reusser | 44/72 |
| 4,460,482 | 7/1984 | Wu | 252/8.555 |
| 4,499,006 | 2/1985 | Valone et al. | 252/392 |

FOREIGN PATENT DOCUMENTS

| | | |
|---|---|---|
| 0074707 | 3/1983 | European Pat. Off. . |
| 1212056 | 3/1960 | France . |
| 2304688 | 5/1976 | France . |

OTHER PUBLICATIONS

Kempter et al., *Journal fur Praktische Chemie,* Band 34, Heft 4, pp. 104–111 (1966).

*Primary Examiner*—John F. Terapane
*Assistant Examiner*—Gary Geist
*Attorney, Agent, or Firm*—R. C. Gaffney; C. J. Caroli

[57] ABSTRACT

A corrosion inhibiting polyalkylenepolyamine composition comprising a mixture of (a) at least one C-alkyl-ethylene diamine, and (b) at least one di-(C-alkyl)-diethylenetriamine or at least one di-(C-alkyl)-piperazine or a mixture thereof;

wherein each C-alkyl group on the ethylene diamine, diethylenetriamine and piperazine independently contains from 10 to 28 carbon atoms. Methods for preparing this composition are also disclosed, as well as methods for its use in inhibiting corrosion of corrodible metals.

46 Claims, No Drawings

POLYALKYLENEPOLYAMINES AS CORROSION INHIBITORS

CROSS-REFERENCE TO RELATED APPLICATIONS

This application is a continuation-in-part of application Ser. No. 001,929, filed January 8, 1987 now abandoned.

BACKGROUND OF THE INVENTION

This invention relates to a hydrocarbon-soluble composition which is useful in inhibiting the corrosion of a corrodible metal material. More particularly, this invention relates to a hydrocarbon-soluble polyalkylenepolyamine composition comprising a mixture of (a) at least one C-alkyl-ethylene diamine and (b) at least one di-(C-alkyl)-diethylenetriamine or at least one di-(C-alkyl)piperazine or mixtures thereof;

wherein each C-alkyl group on the ethylene diamine, diethylenetriamine and pyrazine independently contains from 10 to 28 carbon atoms. This invention also relates to methods for preparing this composition. The invention further relates to a method of inhibiting corrosion in corrodible metals.

Corrosion inhibition in acid systems has been the subject of considerable interest in recent years. In industrial cleaning operations, where aqueous solutions of acid serve to remove scale and other deposits from metallic surfaces of industrial equipment, the inhibitors are used to reduce acid attack on the metals of construction during the cleaning operations. In processing operations where some acid is present or may be generated, inhibitors are introduced to reduce the corrosiveness of the acid. In oil well operations, corrosion inhibitors are introduced during various treatment stages and during secondary recovery operations. In all these operations, the corrosion inhibitor is in a form which is dispersible and preferably miscible in the liquid medium of the particular system.

Since the industrial equipment being protected by the inhibitor is often of considerable value or is often difficult and expensive to replace, significant importance has been given to the development of new and improved corrosion inhibitors. One area of such interest has been the organic inhibitors such as the amines, ketones, sulfides, acetylenic alcohols and the like. In respect to the amines or to their acid salts commonly formed in the acidic systems, fatty amines having one or more amine groups have been recognized as effective inhibitors. Rosin amines have also been used as corrosion inhibitors as have their oxyalkylated derivatives. In addition, various polymeric resins with amine functionalities have been used to some extent. Most of the commercial filming amine corrosion inhibitors are reaction products of fatty acids with ethylene diamine, diethylenetriamine and higher polyamines, resulting in amidoamines and imidazolines.

U.S. Pat. No. 3,770,377 discloses a method for preventing corrosion of metals in an acidic environment by utilizing a corrosion inhibitor which is the reaction product formed by reacting, in the liquid phase and under neutral conditions, at least one carbonyl compound and at least one amine containing a plurality of primary or secondary amino groups. Specific amines taught by this patent include hexamethylene diamine and 1,8-diaminonaphthalene. Specific carbonyl compounds employed include formaldehyde and cyclohexanone.

U.S. Pat. No. 4,554,090 discloses a combination corrosion and scale inhibitor composition comprising the reaction product of (a) a heterocyclic nitrogen-containing compound selected from alkylpyridine, alkylpyrimidine, alkylimidazole, alkylimidazoline, quinoline and quinaldine, (b) an aldehyde, and (c) a phosphoric acid constituent.

U.S. Pat. No. 3,977,981 discloses a method for inhibiting corrosion of corrodible metals utilizing a 14-membered or 16-membered macrocyclic tetramine.

U.S. Pat. No. 4,511,480 discloses a method of inhibiting corrosion of ferrous metals by employing a phosphate ester of an oxyalkylated thiol.

U.S. Pat. No. 4,089,789 discloses a method for inhibiting corrosion of ferrous metal in an acid system utilizing an oxyalkylated phenolic inhibitor comprising the reaction product of (a) an alkylene oxide and (b) a phenolic compound having two non-oxyalkylatable, saturated tertiaryamino alkylene groups.

U.S. Pat. No. 4,388,214 discloses corrosion inhibitors comprising the reaction product of certain imidazolines or precursors thereof and elemental sulfur.

U.S. Pat. No. 4,084,971 discloses a metal protecting composition comprising zinc, a partially hydrolyzed organic silicate, and a fatty acid amidoamine formed by the interaction of an ethylenically unsaturated fatty acid and an alkylene polyamine containing two primary amine groups and at least one secondary amine group wherein the alkylene group contains about 2 to 5 carbon atoms.

U.S. Pat. No. 3,766,053 discloses a method for preventing corrosion utilizing an imidazoline compound formed from the reaction of a naphthenic acid and dipropylene triamine.

U.S. Pat. No. 3,728,277 discloses a corrosion inhibiting composition comprising a mixture of (a) an imidazoline or oxazoline salt of a long chain fatty acid and (b) a salt of a long chain aliphatic amido amine and a long chain aliphatic carboxylic acid.

U.S. Pat. No. 2,940,927 discloses a method of inhibiting corrosion of ferrous metals utilizing the final reaction product obtained by first condensing two moles of a polyamine selected from tetraethylene pentamine, triethylene tetramine, diethylene triamine and ethylene diamine with one mole of a dicarboxylic acid to provide an intermediate bis-imidazoline reaction product, which is then contacted with 1 to 4 moles of ethylene oxide.

U.S. Pat. No. 4,344,861 discloses a method of inhibiting corrosion of metals utilizing the bis-amide reaction product of about one equivalent of a dicarboxylic acid and about one mole ratio of an amine. Among the amines contemplated for use in this method include N-alkyl and N-alkenyl alkylene diamines, wherein the alkylene group contains from 2 to about 10 carbon atoms. Also contemplated are terminally N-substituted polyethylene polyamines, such as diethylenetriamine, triethylenetetramine, tetraethylenepentamine and pentaethylene hexamine.

The preparation of ethylene diamine and other ethylene polyamines is well known in the art. For example, U.S. Pat. No. 1,832,534 discloses the preparation of ethylene diamine by reacting ethylene dichloride with aqueous ammonia at a temperature of about 110° C. and a pressure of about 10 atmospheres.

Similarly, U.S. Pat. No. 2,049,467 describes a procedure for making ethylene polyamines wherein ethylene dichloride and a dilute aqueous solution of ammonia are heated under pressure at temperatures of from 120° C. to 300° C.

U.S. Pat. No. 2,769,841 discloses an improvement in the preparation of ethylene polyamines and polyethylene polyamines by adding diethylenetriamine to a starting mixture of ethylene dichloride and an aqueous solution of ammonia, to reduce the formation of diethylenetriamine and increase the formation of higher polyethylene polyamines.

U.S. Pat. No. 3,751,474 discloses the preparation of relatively high molecular weight polyethylene polyamines by the reaction of ethylene dichloride and aqueous ammonia, using a mole ratio of ammonia to ethylene dichloride of more than 2.6 to 1.

U.S. Pat. No. 4,123,462 describes a process for aminating aliphatic alkane derivatives containing from one to six carbon atoms with ammonia in the presence of a solid nickel-rhenium catalyst, wherein said alkane derivatives are selected from the lower alkanemono-ols, lower alkane diols, lower alkanolamines, and mixtures thereof.

European Patent Application No. 82109001.6 describes a continous process for the manufacture of ethylenediamine from the ethanolamine mixture produced by reacting ethylene oxide with ammonia by providing a continuous monoethanolamine recycle stream to a reaction zone comprising a solid amination catalyst.

East German Pat. No. 149,509 describes a process for the manufacture of a mixture of polyethyleneamines from ethylene oxide and ammonia at high pressure by stepwise non-catalytic reaction with ammonia to produce ethanolamine followed by catalytic reaction with ammonia to produce the polyethyleneamines.

U.S. Pat. No. 4,112,050 discloses a process for removing $CO_2$ from gaseous feeds using sterically hindered amines. Among the many compounds disclosed is 2,2,5,5-tetramethyldiethylenetriamine (Col. 15, lines 27–31).

U.S. Pat. No. 4,293,682 discloses triamines of the general formula:

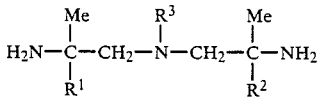

where $R^1$ and $R^2$ can be lower alkyl and $R^3$ can be hydrogen. The polyamines are useful as epoxy curing agents for polyepoxides.

U.S. Pat. No. 4,629,752 discloses particular highly branched chain polyalkylenepolyamines as starting materials for polysubstituted piperazinones, useful as U.V. stabilizers for polymers. See, for example, structure (IX) in Column 12, lines 41–47. These structures require that the carbon adjacent to the primary amines be disubstituted.

Kempter and Moser in J. Prakt. Chem. 34(1–4), 104–11 (1966), CA 66:28324v describe the preparation of even-numbered 1,2-diamines from chromatographically pure even-numbered fatty acids. This procedure involves preparing the 2-bromo-acid, reacting it with thionyl chloride and then ammonia to produce the 2-bromo-amide, reacting the amide with 40–80 equivalents of aqueous ammonia to produce the 2-amino-amide and then reducing this product with lithium aluminum hydride. Aliphatic 1,2-diamines up to $C_{18}$ are disclosed.

U.S. Pat. No. 2,736,658 discloses aliphatic diamines of the structure:

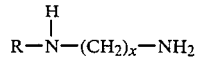

wherein R represents an aliphatic or alicyclic carbon chain attached to nitrogen of from 8–22 carbon atoms and x is a number from 2–10. Preferably, x is 3. These compounds are described as corrosion inhibitors, the effectiveness increasing greatly when the diamines are employed in the form of their fatty or rosin acid salts.

Prior art corrosion inhibitors are generally N-alkylamines or polyamines, wherein the alkyl group is typically in the detergent range. We have now surprisingly discovered that when this alkyl group is attached to carbon rather than nitrogen, polyalkylenepolyamine compositions having improved corrosion inhibiting characteristics are obtained.

SUMMARY OF THE INVENTION

The present invention provides a hydrocarbon-soluble, corrosion inhibiting polyalkylenepolyamine composition comprising a mixture of (a) at least one C-alkylethylene diamine and (b) at least one di-(C-alkyl)-diethylenetriamine or at least one di-(C-alkyl)-piperazine, or a mixture thereof; wherein each C-alkyl group on the ethylene diamine, diethylenetriamine and piperazine independently contains from 10 to 28 carbon atoms.

The present invention also provides a corrosion inhibiting composition comprising the polyalkylenepolyamine product obtained by the reaction of a 1,2-dihaloalkane having from 12 to 30 carbon atoms and ammonia.

The present invention additionally provides a corrosion inhibiting composition comprising the polyalkylenepolyamine product obtained by the reaction of a 1-epoxyalkane having from 12 to 30 carbon atoms and ammonia, in the presence of an amination catalyst and hydrogen.

The present invention further provides a method of inhibiting corrosion of a corrodible metal material which comprises contacting the metal material with an effective amount of the corrosion inhibitor composition of the invention.

The present invention is also concerned with a method of inhibiting corrosion of a corrodible metal material in or around a well through which a corrosive fluid is produced, which comprises contacting the metal material with an effective amount of the corrosion inhibitor composition of the invention.

Among other factors, the present invention is based on our discovery that a mixture of C-alkyl-ethylene diamines and di-(C-alkyl)-diethylenetriamines and/or di-(C-alkyl)-piperazines, wherein each alkyl group independently contains from 10 to 28 carbon atoms, are outstanding corrosion inhibitors in various environments. More particularly, the invention is based, in part, on the discovery that formulations of the presently described polyamines give greater than 90% inhibition of both $CO_2$ and $H_2S$ corrosion in the industry-standard wheel test with NACE brine (National Association of Corrosion Engineers), under both continuous and film persistence test modes. Moreover, the polyamine products of this invention show superior inhibition of $CO_2$ corrosion in film persistence wheel tests at low treatment levels (500–2,000 ppm) when compared with known commercial corrosion inhibitors, such as Tretolite KP310, Nalco Visco 4910 and Nalco Visco 945.

DETAILED DESCRIPTION OF THE INVENTION

The Polyalkylenepolyamines

The polyalkylenepolyamine composition of this invention comprises a mixture of (a) at least one C-alkylethylene diamine and (b) at least one di-(C-alkyl)-diethylenetriamine or at least one di-(C-alkyl)-piperazine, or a mixture thereof; wherein each C-alkyl group on the ethylene diamine, diethylenetriamine and piperazine independently contains from 10 to 28 carbon atoms. Generally, the composition of this invention will contain greater than 1% of component (b), and preferably greater than 5% of component (b), relative to component (a). The ratio of component (b) to component (a) will preferably range from about 0.05:1 to about 20:1.

Preferably the C-alkyl groups on the ethylene diamine, diethylenetriamine and piperazine will each contain from 14 to 22 carbon atoms, and more preferably, from 18 to 22 carbon atoms.

The polyalkylenepolyamine composition of this invention contains a mixture of compounds. This mixture includes at least one C-alkyl-ethylene diamine of Structure 1, wherein R is an alkyl group containing 10 to 28 carbon atoms.

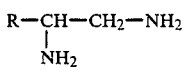

(1)

The composition of this invention also includes at least one di-(C-alkyl)-diethylenetriamine or a di-(C-alkyl)-piperazine, or a mixture thereof. Generally, at least one di-(C-alkyl)-diethylenetriamine of Structure 2 is present.

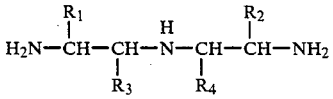

(2)

In Structure 2, $R_1$, $R_2$, $R_3$ and $R_4$ individually may be hydrogen or alkyl of 10 to 28 carbon atoms, provided that two of the $R_1$, $R_2$, $R_3$ and $R_4$ groups are hydrogen and two of the $R_1$, $R_2$, $R_3$ and $R_4$ groups are alkyl.

These di-(C-alkyl)-diethylenetriamines generally include compounds substituted at the 2 and 5 position, at the 2 and 6 positions, and at the 3 and 5 positions. The compounds of Structure 2 can also be described as di-(C-alkyl)-2,2'-diaminodiethylamines.

A cyclized di-(C-alkyl) component may also be present, in addition to, or instead of, the di-(C-alkyl)-diethylenetriamines. Generally, one or both of the di-(C-alkyl) piperazines of Structure 3 is present:

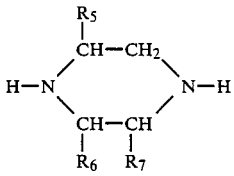

(3)

In Structure 3, $R_5$ is alkyl of 10 to 28 carbon atoms and one of the $R_6$ and $R_7$ groups is hydrogen and the other of the $R_6$ and $R_7$ groups is alkyl having a chain length of from 10 to 28 carbon atoms. These compounds may be described as 2,5- and 2,6-dialkylpiperazines.

It is believed that the above-described dialkyl compounds of Structures 2 and 3 are especially advantageous in controlling corrosion. Preferred alkyl groups are derived from the corresponding linear alpha-olefins. Even-numbered alpha-olephins are preferred. Particularly preferred are the compounds of Structures 1, 2 and 3 wherein the alkyl group contains 14–22 carbon atoms, most preferably 18–22 carbon atoms. Polyalkylenepolyamines having a mixture of alkyl groups containing more than one carbon chain length are especially preferred, as they have increased solubility, lower melting points and lower pour points.

By the term "polyalkylenepolyamine" is meant a mixture of compounds including the alkyl diamines of Structure 1, the higher dialkylpolyamines of Structures 2 and 3, and higher polyalkylenepolyamine oligomers. The alkyl chain can be linear or branched. Although Structures 1, 2 and 3 show primary and secondary amine groups, these amine groups can be substituted with one or more alkyl or aminoalkyl groups. These compounds are also encompassed by the term "polyalkylenepolyamine". As referred to herein, the term "polyamine" is also used to mean "polyalkylenepolyamine".

These polyalkylpolyamines can be present as either the free base or as a salt thereof, such as a hydrochloride salt. Thus, the term "polyalkylenepolyamine" is also meant to include the free base, the ammonium salt form, or mixtures of the two.

As used herein, the term "C-alkyl" refers to an alkyl group directly bonded to carbon, and the term "di-(C-alkyl)" refers to two alkyl groups directly bonded to two different carbon atoms. This usage of "C-alkyl" is similar to the expression "N-alkyl", meaning an alkyl group directly bonded to nitrogen.

Preparation of Polyalkylenepolyamine

The corrosion inhibiting composition of this invention can be prepared by a variety of methods. Suitable methods for preparation of this composition include, but are not limited to the following: reaction of a 1,2-dihalo-($C_{12}$–$C_{30}$)alkane with ammonia, in which the halogen may be chlorine, bromine or iodine; reaction of a 1-epoxy-($C_{12}$–$C_{30}$)alkane with ammonia in the presence of a suitable catalyst; reaction of a 1-amino, 2-($C_{12}$–$C_{30}$)alkanol or 1-amino, di-[2-($C_{12}$–$C_{30}$)alkanol] or mixtures thereof with ammonia in the presence of a suitable catalyst; reaction of a 1,2-($C_{12}$–$C_{30}$) alkanediol with ammonia in the presence of a suitable catalyst; reaction of a ($C_{10}$–$C_{28}$) C-alkylaziridine with ammonia. A critical factor in determining what constitutes a suitable method for preparing the present composition is that the process must provide for the formation of the above-described di-(C-alkyl) component, that is, component (b), in addition to the C-alkyl ethylene diamine of component (a).

Preparation from 1,2-Dihaloalkanes

A preferred method of preparing the present composition is by reacting a 1,2-dihalo-($C_{12}$–$C_{30}$) alkane with ammonia, preferably by the reaction of a 1,2-dichloroalkane and ammonia. Although it is understood that any of the 1,2-dihaloalkanes may be employed, the 1,2-dichloroalkanes will be discussed as representative.

In general, the 1,2-dichloroalkane will contain from 12 to 30 carbon atoms, preferably from 16 to 24 carbon atoms, and more preferably, from 20 to 24 carbon atoms. The 1,2-dichloroalkane employed may be a single carbon number or a mixture of several carbon numbers. The alkane may be branched or linear.

The 1,2-dichloroalkane may be prepared from readily available alpha olefin feedstocks. Suitable alpha olefins are those containing about 12 to 30 carbon atoms, preferably about 16 to 24 carbon atoms, and more preferably, about 20 to 24 carbon atoms. These alpha olefins are normally obtained by the cracking of wax or from the ethylene growth reaction. A particularly useful alpha olefin is the ($C_{20}$–$C_{24}$)-alpha olefin obtained from the ethylene growth reaction.

The alpha olefin is converted to the 1,2-dichloroalkane by reaction of the olefin with molecular chlorine in the presence of a free radical scavenger, such as ferric chloride. The reaction is generally carried out at a temperature in the range of about −15° C. to about +25° C. The reaction pressure is generally ambient, although positive pressures in the range of 0 to 85 psi may be employed. The reaction is normally run in the presence of a solvent, such as carbon tetrachloride, or cyclohexane. The reaction time is generally from 0.5 to 2 hours. The resulting 1,2-dichloroalkane is then isolated from the reaction mixture using conventional techniques. In similar fashion, the alpha olefin may be reacted with molecular bromine or molecular iodine to form the 1,2-dibromoalkane or the 1,2-diiodoalkane.

The polyalkylenepolyamine products of the invention may be prepared by amination of the appropriate 1,2-dichloroalkane with ammonia. The molar ratio of ammonia to 1,2-dichloroalkane will normally range from about 2:1 to 100:1, and preferably from about 4:1 to 50:1. The most preferred ratio is about 5:1 to 20:1.

Although the reaction of 1,2-dichloroalkane and ammonia may be effectively carried out without a solvent, it is generally preferable to run the reaction in the presence of an organic solvent. Contemplated solvents are those polar organic solvents which are inert to the reactants under the presently described reaction conditions. Especially suitable solvents are the alkanols, such as isopropanol. The preferred solvent is alkanol. The weight ratio of ethanol to ammonia will generally range from about 50:50 to 90:10, and preferably from about 60:40 to 80:20.

The amination reaction will generally be carried out under substantially anhydrous conditions. It has been found that the relatively high carbon number 1,2-dichloroalkanes employed herein do not readily form the polyalkylenepolyamine products of the invention in the presence of aqueous ammonia. This is in marked contrast to the known prior art use of aqueous ammonia conditions in the conventional preparation of lower alkylene polyamines, such as polyethylenepolyamine.

The presently described reaction of 1,2-dichloroalkane and ammonia is normally carried out at a temperature in the range of about 100° C. to 250° C., preferably in the range of about 160° C. to 230° C., and most preferably in the range of about 180° C. to 200° C. The reaction pressure is generally in the range of about 500 to 3,000 psi, and preferably about 800 to 1,500 psi. The reaction will normally proceed over a period of about 0.5 to 18 hours, although longer reaction times may be employed, depending upon the temperature and ammonia concentration.

At the termination of the reaction, the polyalkylenepolyamine product is generally in a polyalkylenepolyamine hydrochloride form. If the free base is desired, neutralization may be effected by addition of a strong base, such as calcium hydroxide, sodium hydroxide, potassium hydroxide, and the like. The salt formed from the neutralization may be easily separated from the organic free base. Typically, about 15% vinyl chloride side product is produced using this process. Reaction of the remaining chloride products with sodium metal is advantageous in using the resulting composition as corrosion inhibitors. The isomer distribution does not significantly change after reaction with sodium metal.

Adjusting the Hydrophobic-Hydrophilic Ratio

Advantageously, the hydrophobic-hydrophilic ratio and nitrogen content of the polyalkylenepolyamine product can be readily adjusted by the addition of various amounts of ethylene dichloride, ethylene diamine or a higher polyethylenepolyamine, such as diethylenetriamine, during the reaction of the 1,2-dichloroalkane and ammonia. The amount of ethylene dichloride, ethylene diamine or higher polyethylenepolyamine which may be reacted with the 1,2-dichloroalkane and ammonia will generally range from about 1 to 50 weight percent, and preferably from about 10 to 20 weight percent.

Preparation from 1-Epoxyalkane

A second preferred method of preparing the polyalkylenepolyamines of the invention is by reaction of a 1-epoxyalkane with ammonia in the presence of a suitable amination catalyst. In general, the 1-epoxyalkane will contain from 12 to 30 carbon atoms, preferably from 16 to 24 carbon atoms, and more preferably, from 20 to 24 carbon atoms. The 1-epoxyalkane employed may be a single carbon number or a mixture of several carbon numbers. The alkane may be branched or linear.

The 1-epoxyalkane may be prepared from readily available alpha-olefin feedstocks. As discussed above, suitable alpha-olefins are those containing about 12 to 30 carbon atoms, preferably about 16 to 24 carbon atoms, and more preferably, about 20 to 24 carbon atoms. These alpha-olefins are normally obtained by the cracking of wax or from the ethylene growth reaction. A particularly useful alpha-olefin is the ($C_{20}$–$C_{24}$)-alpha-olefin obtained from the ethylene growth reaction.

The alpha-olefin is converted to the 1-epoxyalkane by reaction of the olefin with a peracid such as performic acid, peracetic acid, perpropionic acid, and the like according to procedures well-known in the art.

The polyalkylenepolyamine composition of the invention can be prepared by amination of the appropriate 1-epoxyalkane with ammonia in the presence of a suitable catalyst and hydrogen. The molar ratio of ammonia to 1-epoxyalkane affects the molecular weight distribution of the final polyalkylenepolyamine product and will normally range from about 2:1 to 100:1 and preferably from about 8:1 to 50:1. Reaction of ammonia with the 1-epoxyalkane to form a mixture of mono- di- and tri-alkanolamines takes place in the presence or absence of a catalyst in the temperature range 100°–200°

C. Further reaction of the alkanolamines with ammonia to form the instant polyalkylenepolyamines requires a catalyst under hydrogen pressure and takes place in the temperature range 120°–230° C. The two reactions may be carried out in separate reaction zones, or together in the presence of hydrogen and the catalyst.

The presently described reaction of 1-epoxyalkane and ammonia is normally carried out in a single reactor at a temperature in the range of about 100° to 250° C., preferably in the range of about 150° to 230° C. and most preferably in the range of about 160° to 190° C. The reaction pressure is generally in the range of about 500 to 3,000 psi, and preferably between about 500 to 1,500 psi. The reaction is normally charged at room temperature with hydrogen gas to a pressure of about 25 to 400 psi, and preferably to a pressure of about 100 to 300 psi. The catalyst employed in the reaction may be either supported or unsupported, and is generally present in an amount equal to about 0.1% to 30% of the weight of 1-epoxyalkane, and preferably 1% to 10% of the weight of 1-epoxyalkane. The reaction will normally proceed over a period of about 1 hour to 20 hours. The resulting polyalkylenepolyamine is isolated simply by flashing the volatile hydrogen, ammonia and water and filtering off the catalyst.

Alternatively, the reaction can be carried out in two separate steps. The mixture of mono-, di- and trialkanolamines obtained from reaction of 1-epoxyalkane with ammonia at an ammonia to 1-epoxyalkane molar ratio between 2:1 and 100:1 and preferably between 8:1 and 50:1 can be isolated and used in place of the 1-epoxyalkane following the procedure above.

It is also envisioned that the reaction may be carried out in a continuous fashion with similar ratios of ammonia, 1-epoxyalkane and hydrogen passing in a plug-flow reactor over a bed of solid catalyst. This continuous process may also allow for separate reaction zones for (1) non-catalytic conversion of the 1-epoxyalkane to alkanolamines mixture, for example in a preheater segment of the continuous reaction unit, and (2) catalytic amination of the alkanolamines mixture to polyalkylenepolyamines.

Amination catalysts for converting alcohols to amines are known in the art and include nickel-containing and cobalt-containing catalysts. Preferred catalysts include Raney Nickel, nickel chromite, supported cobalt catalysts such as Harshaw-Filtrol Co-0138E, supported nickel-rhenium catalysts such as that described in U.S. Pat. No. 4,111,840, and supported nickel catalysts such as Harshaw-Filtrol Ni5136P. Most preferred are supported cobalt and supported nickel-rhenium catalysts.

Adjusting the Hydrophobic-Hydrophilic Ratio

Advantageously, the hydrophobic-hydrophilic ratio and nitrogen content of the polyalkylenepolyamine product can be readily adjusted by the addition of various amounts of ethylene diamene or a higher polyethylenepolyamine during the reaction of the 1-epoxyalkane and ammonia. The amount of ethylene diamine or higher polyethylenepolyamine which may be reacted with the 1-epoxyalkane and ammonia will generally range from about 1 to 50 weight percent, and preferably from about 10 to 20 weight percent.

Corrosion Inhibition

The polyalkylenepolyamines of this invention are surprisingly good corrosion inhibitors. In comparison with commercial corrosion inhibitors, they show much superior performance.

For use as corrosion inhibitors, the polyamines of the invention are applied to the metal surfaces to be protected in a variety of ways known to the art. For example, a dilute hydrocarbon solution of the polyamine may be contacted with the metal to be protected, using methods such as dipping, spraying, wiping, and the like. For this method of application, solutions of about 0.1 to 10%, preferably from about 0.2 to 1%, by weight of polyalkylenepolyamine, or mixture of polyalkylenepolyamine and other active corrosion inhibiting agents, are employed.

Alternatively, oil-soluble, water-dispersible formulations of the present polyamines, or mixtures of the polyamines and other active corrosion inhibiting agents, can be added to a corrosive aqueous environment. In this method of application, sufficient amounts of polyamine, or mixture of the polyamine and other active corrosion inhibiting agents, are added to give from about 1 to 1,000 ppm, preferably from 10 to 500 ppm, of active corrosion inhibitor in the final solution for continuous methods of treatment. For batch treatment methods, the level of corrosion inhibiting agents is generally between 500 and 25,000 ppm, preferably between 1,000 and 10,000 ppm.

Generally, corrosion inhibitors are formulated with other components for corrosion inhibiting application.

Preferably, the corrosion inhibiting polyalkylenepolyamine composition of the present invention will be combined with one or more dimer/trimer acids to provide a formulated product. Dimer/trimer acids are well-known in the art and are typically derived from fatty acids. Examples of dimer/trimer acids include Empol 1024, Empol 1041 and Empol 1052, obtained from Emery Chemicals.

In addition to the polyalkylenepolyamine of the invention and the dimer/trimer acid, corrosion inhibiting formulations may also contain one or more surfactants, one or more alcohols and a hydrocarbon solvent. The surfactant employed may be ionic or nonionic in nature. Generally, nonionic surfactants are preferred. Typical nonionic surfactants include ethoxylated nonylphenols such as Igepal CO-630 and Igepal CO-710, and ethoxylated fatty alcohols such as Tergitol 15-S-9. The hydrocarbon solvent may be any of the known solvents, such as kerosene, diesel fuel, paint thinner, toluene, lubricating oil, and similar materials. A typical hydrocarbon solvent is kerosene. Isopropanol is a typical alcohol.

Generally, the active corrosion inhibiting agents will be combined with a solvent and a surface-active agent to produce a concentrated solution of the corrosion inhibitor. In this solution, the polyamine, or mixture of the polyamine and other active corrosion inhibiting agents, will be present in amounts ranging from about 10 to 60%, preferably about 30 to 50%, by weight. The amount of solvent present is from about 30 to 80%, and the amount of surfactant is about 1 to 20%, by weight. This concentrated formulation is then diluted to the desired concentration of the final solution.

A typical oil-soluble, water-dispersible formulation will contain about 15 to 30% of the present polyalkylenepolyamine, about 15 to 30% of a dimer/trimer acid, about 1 to 10% of a nonionic surfactant, about 25 to 75% of a hydrocarbon solvent, such as kerosene, and about 0 to 5% of an alcohol, such as isopropanol.

Oil-soluble, water-dispersible formulations of the present polyamines are particularly useful in brine/$CO_2$ or brine/$H_2S$ environments, such as encountered in oil wells, especially oil wells employing secondary oil recovery techniques.

In standard wheel tests using NACE brine at 90° C., tested in both saturated $CO_2$ solution and in 500 ppm $H_2S$, formulations of the polyamines of the present invention provided corrosion protection of greater than 90% over the treatment range of 20 to 100 ppm in continuous tests and 2,000 to 10,000 ppm in film persistence tests.

For example, side-by-side film persistence tests in $CO_2$ saturated NACE brine were carried out at a 2,000 ppm treatment level. The polyamines of the present invention provided 96% corrosion inhibition whereas the commercial corrosion inhibitor, Nalco Visco 945, provided only 82% corrosion inhibition.

Moreover, when film persistence tests in $CO_2$ saturated NACE brine were carried out at lower treatment levels, formulations of the polyamines of the present invention continued to provide greater than 90% corrosion inhibition at treatment levels as low as 500 ppm, whereas the commercial corrosion inhibitors Tretolite KP310 and Nalco Visco 4910 failed to provide at least 90% corrosion inhibition at treatment levels lower than 1,000 ppm and 5,000 ppm, respectively. Tretolite KP310, available from Petrolite Corporation is described as a liquid oil-soluble organic film forming inhibitor effective against corrosion caused by $H_2S$, $CO_2$, and organic and mineral acids. Nalco Visco 4910 and Nalco Visco 945, available from Nalco Chemical Company, are described as oil-soluble, water-dispersible corrosion inhibitors, formulated to control sweet and sour corrosion.

It has also been found that formulations of the polyalkylenepolyamines of the present invention containing the di-(C-alkyl)-diethylenetriamine and/or di-(C-alkyl)-piperazine compounds show improved adhesion to metal surfaces. These formulated products were observed to visibly stick to mild steel coupons more tenaciously than commercial formulated products, such as Nalco 945.

The following examples are provided to illustrate the invention in accordance with the principles of this invention but are not to be construed as limiting the invention in any way except as indicated by the appended claims.

EXAMPLES

Example 1

Preparation of 1,2-dichloro($C_{20}$–$C_{24}$)alkane

The alpha olefin used in this example was Gulftene 20–24, a linear $C_{20}$–$C_{24}$ alpha olefin fraction obtained from Chevron Chemical Company.

To a 1-liter autoclave equipped with an air-drive stirrer, freon cooling coil system, nitrogen purge lines and a dip tube hooked up to a chlorine gas lecture bottle was added 300 g Gulftene 20–24, 600 g carbon tetrachloride, and 6 g anhydrous $FeCl_3$. The mixture was stirred at 750 to 1000 rpm, purged with nitrogen and cooled to 0° C. The nitrogen purge was then discontinued, and chlorine gas was added gradually over the course of 35 minutes, keeping the temperature between 0° C. to 5° C. Upon completion of the chlorine addition, nitrogen was purged through the solution for 1 hour to remove any unreacted chlorine gas. The crude reaction mixture was washed with 400 ml of 5 weight percent NaOH, followed by two water washes, after which the organic phase was separated and filtered. The carbon tetrachloride solvent was removed on a rotary evaporator to yield 360 g of crude product containing 19.0 weight percent Cl. $^1H$ NMR analysis of the product shows no evidence of any olefinic protons in the region 4.6 to 6.0 ppm, where the olefinic proton resonances of the starting alpha olefin appear, and shows a clear multiplet pattern in the region 3.6 to 4.1 ppm, characteristic of the vicinal dichloride functionality, thus verifying complete conversion of the alpha olefin to 1,2-dichloride.

Example 2

Preparation of Poly($C_{20}$–$C_{24}$)alkylenepolyamines

To a 300-cc, 316 stainless steel autoclave equipped with an Athena temperature controller and an airdrive stirrer were added 12.9 g of the dichloride from Example 1 and 54 g absolute ethanol. The autoclave was sealed, and 23.1 g ammonia was added, using a HOKE bomb to carry out the transfer between the ammonia cylinder and the autoclave. The stirrer was turned on and temperature raised to 195° C. over the course of 20 minutes. The reaction was carried out for 2 hours at 195° C. and 900 psi, and then cooled to room temperature. The autoclave was vented, the crude product removed with methylene chloride and evaporated to dryness. The resulting solid was taken up in 150 ml of methylene chloride, washed with 200 ml 5% NaOH, twice with distilled water and filtered. The methylene chloride was then removed on a rotary evaporator at 55° C. under 3 mm Hg vacuum to a constant weight. 9.97 g of crude product, melting at 55°–62° C., were obtained, which by elemental analysis contained 77.01% C, 13.35% H, 4.78% N, and 3.31% Cl. $^1H$ NMR analysis of this product showed, in addition to some residual resonances in the region 3.6 to 4.1 ppm from unreacted starting material, complex new multiplets in the region 2.4 to 2.9 ppm, characteristic of a mixture of vicinal diamino functional groups. Some resonances in the region 5.0 to 6.1 ppm also appeared, and were confirmed by independent synthesis and analysis to be caused by small amounts of vinyl chloride elimination product. Based on the % Cl in the crude product, and on the ratio of vinyl chloride to dichloride starting material as obtained from the $^1H$ NMR data, the conversion of the starting dichloride to product was calculated to be 86% and selectivity of the converted product to polyamine versus vinyl chloride was 91%. Field ionization mass spectral (FIMS) analysis of the product showed that 90% of the product was the monomeric C-alkyl-ethylene diamines, 9% of the product was the dimeric di-(C-alkyl) compounds, and that small amounts of higher oligomers were also obtained.

Examples 3–11

Preparations of Poly($C_{20}$–$C_{24}$)alkylenepolyamines

Additional polyalkylenepolyamines were prepared using variations in reaction temperature, reaction time, and reaction solvent from the procedure specified in Example 2. With the exception of Example 3, all of these reactions produced reasonable yields of polyalkylenepolyamines with various conversions and selectivities, calculated as outlined in Example 2 and summarized in Table I below. Example 3 is significant because it illustrates that polyalkylenepolyamines with large alkylene groups, such as $C_{20}$–$C_{24}$, cannot be prepared under the aqueous ammonia conditions used for traditional manufacture of polyethylenepolyamines.

Table II shows the product distribution for the products of Examples 2, 9, 10 and 11. Table II demonstrates that, by varying reaction conditions, varying amounts of dimer and higher polyamines can be obtained.

TABLE I

Reaction of 1,2-Dichloroalkane With Ammonia

| Ex. | Solvent | $NH_3$/1,2-dichloroalkane, mole Ratio | $NH_3$/$NH_3$ and solvent, % | Time, (hrs) | Temp., (°C.) | Pressure, P (psi) | Dichloride Conversion | Select.[1] | % N in Crude Product |
|---|---|---|---|---|---|---|---|---|---|
| 3 | 12% $H_2O$/83% EtOH | 41.4 | 5 | 4 | 130 | 90 | 0% | — | 0 |
| 4 | $NH_3$ | 138 | 100 | 18 | 115 | 1500 | 68% | 68% | 2.26 |
| 5 | Ethanol | 41.4 | 47 | 18 | 115 | 900 | 72% | 68% | 3.60 |
| 6 | Ethanol | 41.4 | 30 | 89 | 110 | 700 | 90% | 78% | 4.95 |
| 7 | Ethanol | 41.4 | 30 | 4 | 160 | 950 | 85% | 75% | 4.85 |
| 8 | Ethanol | 41.4 | 30 | 4 | 195 | 1200 | 94% | 91% | 5.35 |
| 9 | Isopropanol | 5.0 | 18 | 4 | 195 | 980 | 83% | 86% | — |
| 10 | Isopropanol | 7.8 | 26 | 4 | 195 | 1340 | 93% | 87% | — |
| 11 | Isopropanol | 10.6 | 32 | 4 | 195 | 1660 | 100% | 86% | 5.27 |

[1]Selectivity is to aminated product; the remainder is mostly vinyl chloride.

TABLE II[1]

Polyalkylenepolyamine Product Distribution

| Ex. | $NH_3$/1,2-dichloroalkanes, Mole Ratio | Product Distribution Monomer[2] | Dimer[3] | Trimer[4] | Tetramer[5] |
|---|---|---|---|---|---|
| 2 | 41.4 | 90 | 9 | 1 | — |
| 9 | 5.0 | 12 | 70 | 18 | 1 |
| 10 | 7.8 | 7 | 32 | 35 | 26 |
| 11 | 10.6 | 28 | 63 | 8 | 1 |

[1]As determined by field ionization mass spectroscopy (FIMS)
[2]C—alkyl ethylene diamine
[3]Di(C—alkyl)polyamine
[4]Tri(C—alkyl)polyamine
[5]Tetra(C—alkyl)polyamine

Example 12

Preparation of $C_{20}$–$C_{24}$ alkanolamines Mixture 252 g of 1-epoxy($C_{20-24}$)alkane, obtained from Viking Chemical Company under the trade name "Vikalox 20–24", was added to a stirred, 1 gallon stainless steel autoclave along with 503 g isopropanol and 840 g anhydrous ammonia. This corresponds to an ammonia to epoxyalkane mole ratio of 60:1. This mixture was heated at 150° C. at a pressure of 1,590 psi for 2 hours. Upon completion of the reaction, the crude alkanolamine was stripped of ammonia and isopropanol at 95° C. using a rotary evaporator with 1 mm Hg vacuum.

The NMR spectrum of the product indicated complete conversion of the starting epoxide, and exhibited the following proton NMR resonances: multiplet at 2.45–2.58 and a doublet of doublets at 2.83 and 2.87 ppm, characteristic of the alkanolamine structures. Nitrogen analysis of the product was 3.58%.

From the theoretical nitrogen contents of pure monoalkanolamine (4.20%) and pure dialkanolamine (2.16%), the experimentally obtained nitrogen content is calculated to correspond to a mixture of approximately 70% monoalkanolamine and 30% dialkanolamine.

Examples 13–15

Additional $C_{20}$–$C_{24}$ alkanolamines mixtures were prepared according to the procedure in Example 12, except for the mole ratio of ammonia to epoxyalkane. The nitrogen contents and calculated mono-, di- and tri-alkanolamine contents are summarized in Table III below:

TABLE III

| Ex. | Ammonia: Epoxyalkane, Mole Ratio | Experimental N, % | % Monoalkanol amine | % Dialkanol amine | % Trialkanol amine |
|---|---|---|---|---|---|
| 13 | 30:1 | 3.32 | 57 | 43 | — |
| 14 | 10:1 | 2.73 | 28 | 72 | — |
| 15 | 5:1 | 1.77 | — | 55 | 45 |

These examples show that, at lower ammonia to epoxyalkane mole ratios, higher amounts of dimeric and higher alkanolamines are produced. These mixtures of alkanolamines can be converted to polyalkylenepolyamines by reaction with additional ammonia and an amination catalyst, as in Examples 19–21.

Example 16

Preparation of poly($C_{20-24}$)alkylenepolyamine from 1-epoxy($C_{20-24}$)alkane with Raney Nickel Catalyst Raney Nickel as obtained from Grace Davison Chemical Company was dried and crushed to a fine powder under an inert atmosphere prior to use. 3.0 g of 1-epoxy($C_{20-24}$)alkane, obtained from Viking Chemical Company under the trade name "Vikalox 20–24" and 0.3 g dried Raney Nickel were combined in a 17 cc stainless steel microbomb under an inert atmosphere. 2.0 g anhydrous ammonia was weighed into the dry ice-acetone bath cooled microbomb, after which hydrogen gas was added to a total reactor pressure of 350 psi. The reaction was carried out at 200° C. for 4 hours. The microbomb was then cooled, vented, and the crude product mixture dissolved in 50 cc warm chloroform and allowed to settle. The supernatant solution was decanted from the catalyst, and the chloroform stripped away on a rotary evaporator.

NMR analysis of the product showed essentially complete conversion of the starting epoxide to a mixture of approximately 64% poly($C_{20-24}$)alkylenepolyamine as evidenced by its characteristic multiplets at 2.42–2.48, 2.67 and doublet of doublets at 2.73 and 2.77 and 21% alkanolamines showing a multiplet at 2.45–2.58 and a doublet of doublets at 2.83 and 2.87 ppm. Elemental analysis indicated a nitrogen content of 4.01%.

Example 17

Preparation of poly($C_{20-24}$)alkylenepolyamine from 1-epoxy($C_{20-24}$)alkane with Cobalt Catalyst The same procedures were followed as in Example 16, except that the catalyst used in place of Raney Nickel was Co-0138E, a commercial supported cobalt catalyst obtained from Harshaw-Filtrol Company.

NMR analysis of this reaction indicated complete conversion of the starting epoxide to a mixture of approximately 81% poly($C_{20-24}$)alkylenepolyamine and 17% alkanolamines as identified by the resonances indicated in the above examples. Elemental analysis of this product indicated 3.73% N.

Example 18

Preparation of poly($C_{20-24}$)alkylenepolyamine from 1-epoxy($C_{20-24}$)alkane with Nickel Chromite Catalyst The same procedures were followed as in Example 16, except that the catalyst used in place of Raney Nickel was a commercial Nickel Chromite catalyst obtained from ALFA Products. This reaction was run for 6 hours, after which NMR analysis of the product indicated approximately 52% poly($C_{20-24}$)alkylenepolyamine and 48% alkanolamines as identified by the resonances indicated in the above examples.

Example 19

Preparation of poly($C_{20-24}$)alkylenepolyamine from $C_{20-24}$alkanolamines with Raney Nickel Catalyst The same procedures were followed as in Example 16, except that the $C_{20-24}$alkanolamines mixture prepared as described in Example 12 was used in the place of 1-epoxy($C_{20-24}$)alkane as the starting material, and the reaction was run for 28 hours. NMR analysis of this product indicated a mixture of approximately 79% poly($C_{20-24}$)alkylenepolyamine and 6% alkanolamines.

Example 20

Preparation of poly($C_{20-24}$)alkylenepolyamine from $C_{20-24}$alkane with Nickel Catalyst The same procedures were followed as in Example 16 above, except that a commercial Harshaw-Filtrol Nickel 5136P catalyst was used in place of Raney Nickel and the reaction was run for 6 hours. NMR analysis of this product indicated a mixture of approximately 72% poly($C_{20-24}$)alkylenepolyamine and 28% alkanolamines as identified by the resonances indicated in the above examples.

Example 21

Preparation of poly($C_{20-24}$)alkylenepolyamine from $C_{20-24}$alkanolamines with Nickel-Rhenium Catalyst The same procedures were followed as in Example 19 above, except that a Nickel-Rhenium supported on alpha alumina catalyst prepared according to the procedure in U.S. Pat. No. 4,111,840 was used in place of Raney Nickel and the reaction was run for 6 hours. NMR analysis of this product indicated a mixture of approximately 86% poly($C_{20-24}$)alkylenepolyamine and 14% alkanolamines, as identified by the resonances indicated in the above examples. The melting point of this product was 61°-72° C. Field ionization mass spectral analysis of the product showed that 52% of the product was the monomeric C-alkylethylenediamine and 46% of the product was the dimeric di(C-alkyl) diethylenetriamine or di(C-alkyl) piperazine or mixtures of these.

Example 22

Preparation of Copolymers of ($C_{20}$-$C_{24}$)alkyleneand ethylenepolyamines

In order to demonstrate that it is possible to increase the nitrogen content and thus vary hydrophilic/hydrophobic properties of the product, polyalkylenepolyamines containing a mixture of $C_{20}$-$C_{24}$ alkylene groups and ethylene groups were prepared by using equal molar amounts of ethylenediamine and 1,2-dichloro($C_{20}$-$C_{24}$)alkane in the amination reaction.

To a 300-cc, 316 stainless steel autoclave equipped with an Athena temperature controller and an airdrive stirrer were added 12.93 g of the dichloride from Example 1, 2.06 g ethylenediamine and 54 g absolute ethanol. The autoclave was sealed, and 38 g ammonia was added, using a HOKE bomb to carry out the transfer between the ammonia cylinder and the autoclave. The stirrer was turned on and temperature raised to 160° C. over the course of 20 minutes. The reaction was carried out for 4 hours at 160° C. and 850 psi, and then cooled to room temperature. The autoclave was vented, the crude product removed with methylene chloride, and evaporated to dryness. The resulting solid was taken up in 150 ml of methylene chloride, washed with 200 ml 5% NaOH, twice with distilled water and filtered. The methylene chloride was then removed on a rotary evaporator at 55° C. under 3 mm Hg vacuum to a constant weight. 10.94 g of crude product were obtained, which by elemental analysis contained 77.71% C., 13.26% H, 5.39% N, and 2.51% Cl. $^1H$ NMR analysis of this product showed the same complex new multiplets in the region 2.4 to 2.9 ppm characteristic of the polyamine product, as described in Example 2, only these had a greater intensity relative to the polyamine products obtained with 100% $C_{20}$-$C_{24}$ alkylene groups. This greater intensity corresponds to a greater content of 1,2-diaminoethylene linkages in the product. This $^1H$ NMR result and the higher % N (5.39% versus 4.85% for Example 7 run under similar conditions without the addition of ethylenediamine) verify the incorporation of ethylenediamine into the final polyalkylenepolyamine product mixture.

Example 23

Formulation of Poly($C_{20}$-$C_{24}$)alkylenepolyamines for $CO_2$ and $H_2S$ Corrosion Inhibition It is well known in the art that filming amines are usually formulated with other active ingredients and surfactants to produce a formulation which is effective against $CO_2$ and $H_2S$ corrosion in oil field environments. For the purposes of the corrosion tests reported in Examples 24 and 26, the following formulation of polyalkylenepolyamines was used for the polyamines of Examples 2-11:

Formulation A

| Ingredient | Weight Percent |
|---|---|
| Polyalkylenepolyamine | 16.4% |
| Empol 1052 Dimer/Trimer Acid | 12.0% |
| Dodecylbenzenesulfonic Acid | 1.6% |
| Igepal CO630 Ethoxylated Nonylphenol | 1.0% |
| Exxon HAN heavy aromatic naphtha | 69.0% |

The following formulation of polyalkylenepolyamines was used for the corrosion tests show in Example 25 using the polyamines of Example 21:

| Formulation B | |
|---|---|
| Ingredient | Weight Percent |
| Polyalkylenepolyamine | 15.0% |
| Empol 1052 Dimer/Trimer Acid | 13.2% |
| Dodecylbenzenesulfonic Acid | 2.0% |
| Igepal CO630 Ethoxylated Nonylphenol | 1.0% |
| Exxon HAN heavy aromatic naphtha | 68.8% |

Example 24

Wheel Test Evaluation of Poly($C_{20}$-$C_{24}$)alkylenepolyamines as Corrosion Inhibitors for $CO_2$ and $H_2S$ Corrosion The wheel test is an industry-standard test procedure for evaluating corrosion inhibitors. This test is described in the National Association of Corrosion Engineers (NACE) publication 1D182. The procedures followed in this example are essentially the same as those described in the NACE publication, and are summarized below.

The test fluids consisted of 90% synthetic brine as described in NACE publication 1D182 and 10% deodorized kerosene. For $CO_2$ corrosion tests, the brine was deaerated with nitrogen, then saturated with $CO_2$ by purging with $CO_2$ gas at room temperature. For $H_2S$ corrosion tests, $H_2S$ gas was bubbled through the deaerated brine until a level of 500 ppm was reached, as determined by reaction with iodine and titration with sodium thiosulfate. Test coupons were 5-mil thick mild steel shimstock and were sandblasted in a ball mill and tared prior to use. The test coupon, test fluids, and inhibitor were placed in a 7-oz. juice bottle taking care to avoid oxygen contamination. The bottles were capped and placed on a rotating wheel mounted in a 90° C. oven. Following the test, the coupons were removed from the bottles, rinsed with soap and water, dipped in 10% hydrochloric acid, and rinsed with water. A plastic wool pad was used to scrub any remaining corrosion products from the coupon, after which the coupon was rinsed, dried, and weighed to determined the weight loss. The percent inhibition provided by the inhibitor was calculated with reference to the weight loss of an uninhibited coupon, according to the formula:

$$\% \text{ Inhibition} = \frac{(\text{Uninhibited weight loss} - \text{Inhibited weight loss})}{\text{Uninhibited weight loss}}$$

For continuous tests, the inhibitor was added at a level of either 20, 50, or 100 ppm, and the bottle placed on the wheel for 24 hours.

For film persistence tests, the coating step consisted of adding the inhibitor at a level between 500 and 25,000 ppm and placing the bottle on the wheel for 1 hour. A rinsing step followed consisting of removing the coupon from the bottle used for the filming step, replacing it in a second bottle containing fresh fluids, and placing this bottle on the wheel for 1 hour. Finally, a testing step was carried out, in which the coupon was placed in a third bottle containing fresh fluids and placed on the wheel for 24 hours.

Table IV below summarizes the corrosion inhibitor test results obtained using this procedure for formulations of the poly($C_{20}$-$C_{24}$)alkylenepolyamines prepared as described in Examples 6 and 9 above.

TABLE IV

| Wheel Test Conditions | Percent Inhibition Polyalkylenepolyamine from Example 6 | Percent Inhibition Polyalkylenepolyamine from Example 9 |
|---|---|---|
| $CO_2$ Continuous | | |
| 20 ppm | 96 | 99 |
| 50 ppm | 98 | 99 |
| 100 ppm | 96 | 100 |
| $H_2S$ Continuous | | |
| 20 ppm | 94 | 94 |
| 50 ppm | 98 | 98 |
| 100 ppm | 96 | 97 |
| $CO_2$ Film Persistence | | |
| 5,000 ppm | 96 | 99 |
| 10,000 ppm | 97 | 98 |
| $H_2S$ Film Persistence | | |
| 5,000 ppm | 97 | 98 |

Example 25

Following the test procedure of Example 24, a sample of polyalkylenepolyamine prepared as described in Example 21 was formulated as described in Example 23 (Formulation B) and evaluated in a $CO_2$ film persistence wheel test at 2,000 ppm treatment level and 190° F. side-by-side with Nalco Visco 945, a commercial corrosion inhibitor formulation available from Nalco Chemical Company. After 24 hours, the polyalkylenepolyamine formulation of the present invention had provided 96% corrosion protection, whereas the commercial Nalco Visco 945 inhibitor provided only 82% corrosion protection.

Example 26

Comparison of Corrosion Inhibitor Performance of Formulated Poly($C_{20}$-$C_{24}$)alkylenepolyamines and Other Commercial Corrosion Inhibitors in $CO_2$: Film Persistence Wheel Test Evaluation In addition to the standard testing conditions described in Example 24, the materials of the present invention were also tested against several commercial inhibitor formulations at low film persistence test treatment levels. Using the same test procedures as described in Example 24, a performance advantage was demonstrated for both the poly($C_{20}$-$C_{24}$)alkylenepolyamines of Examples 2 and 8 and their copolymers with ethylenepolyamines from Example 22. This data is summarized in Table V.

TABLE V

| | $CO_2$ Film Persistence Wheel Tests | | | | |
|---|---|---|---|---|---|
| | Percent Inhibition | | | | |
| Treatment Level, ppm | Polyamine Example 2 | Polyamine Example 8 | Polyamine Example 22 | Tretolite KP310 | Nalco 4910 |
| 500 | 95 | 97 | 95 | 85 | 78 |
| 1,000 | 99 | 99 | 96 | 91 | 83 |
| 2,000 | 97 | 94 | 94 | 94 | 81 |
| 5,000 | 100 | 97 | 92 | 98 | 87 |

Example 27

Comparison of Corrosion Inhibitor Performance of Formulated Poly($C_{20}$–$C_{24}$)alkylenepolyamines and Other Commercial Corrosion Inhibitors in $CO_2$: Linear Polarization Test Evaluation Cleaned and degreased mild steel coupons were immersed in a synthetic seawater solution saturated with $CO_2$ gas at 90° C. and equilibrated for 18 hours. The instantaneous general corrosion rates were electrochemically measured using the standard linear polarization method to give the uninhibited corrosion rates for the test coupons, typically 100 to 150 mpy (mils per year) in this environment. To these solutions were then added sufficient amounts of formulated inhibitor to reach 100 ppm total formulation in the corrosion solution. A comparison was made with Nalco Visco 4907, a commercial nitrogen-containing corrosion inhibitor formulation, available from Nalco Chemical Company. The commercial Nalco formulation was used as received. The poly($C_{20}$–$C_{24}$)-alkylenepolyamine sample of Example 6 was used in a formulation similar to that of Example 23 (Formulation A), except that the level of Igepal CO630 surfactant was 10%.

Following addition of the formulated inhibitors, the corrosion rate, CR, was monitored and the percent inhibition calculated according to the formula:

$$\% \text{ Inhibition} = \frac{(\text{Uninhibited } CR - \text{Inhibited} CR)}{\text{Uninhibited} CR}$$

Both inhibitor formulations quickly lowered the corrosion rate and provided significant inhibition. Following 18 hours, the inhibited corrosion rates had stabilized at 7 mpy for the Nalco formulation and at 2.2 mpy for the formulated polyalkylenepolyamine inhibitor.

What is claimed is:

1. A polyalkylenepolyamine composition comprising a mixture of (a) at least one C-alkyl-ethylene diamine, and (b) at least one di-(C-alkyl)-diethylenetriamine or at least one di-(C-alkyl)-piperazine or a mixture thereof; wherein each C-alkyl group on the ethylene diamine, diethylenetriamine and piperazine independently contains from 10 to 28 carbon atoms; and wherein the composition contains greater than 1% of component (b), relative to component (a).

2. The composition according to claim 1, wherein the composition contains greater than 5% of component (b), relative to component (a).

3. The composition according to claim 1, wherein the ratio of component (b) to component (a) is in the range of about 0.05:1 to about 20:1.

4. The composition according to claim 1, wherein each C-alkyl group independently contains from 14 to 22 carbon atoms.

5. The composition according to claim 4, wherein each C-alkyl group independently contains from 18 to 22 carbon atoms.

6. A composition comprising the polyalkylenepolyamine product obtained by the reaction of a 1,2-dihaloalkane having from 12 to 30 carbon atoms and ammonia.

7. The composition according to claim 6, wherein the 1,2-dihaloalkane is 1,2-dichloroalkane.

8. The composition according to claim 6, wherein the 1,2-dihaloalkane has from 16 to 24 carbon atoms.

9. The composition according to claim 8, wherein the 1,2-dihaloalkane has from 20 to 24 carbon atoms.

10. The composition according to claim 6, wherein the molar ratio of ammonia to 1,2-dihaloalkane is about 2:1 to 100:1.

11. The composition according to claim 6, wherein the reaction is carried out under substantially anhydrous conditions.

12. The composition according to claim 6, wherein the reaction is carried out in the presence of an inert polar organic solvent.

13. The composition according to claim 12, wherein the solvent is an alkanol.

14. The composition according to claim 6, wherein the 1,2-dihaloalkane and ammonia are reacted with about 1 to 50 weight percent of ethylene diamine, a higher polyethylenepolyamine or ethylene dichloride to form the polyalkylenepolyamine product.

15. A composition comprising the polyalkylenepolyamine product obtained by the reaction of a 1-epoxyalkane having from 12 to 30 carbon atoms and ammonia, in the presence of an amination catalyst and hydrogen.

16. The composition according to claim 15, wherein the 1-epoxyalkane has from 16 to 24 carbon atoms.

17. The composition according to claim 16, wherein the 1-epoxyalkane has from 20 to 24 carbon atoms.

18. The composition according to claim 15, wherein the molar ratio of ammonia to 1-epoxyalkane is about 2:1 to 100:1.

19. The composition according to claim 15, wherein the amination catalyst is selected from the group consisting of cobalt-containing and nickel-containing catalysts.

20. The composition according to claim 19, wherein the amination catalyst is a supported cobalt catalyst.

21. The composition according to claim 19, wherein the amination catalyst is a supported nickel-rhenium catalyst.

22. The composition according to claim 15, wherein the 1-epoxyalkane and ammonia are reacted with about 1 to 50 weight percent of ethylene diamine or a higher polyethylenepolyamine to form the polyalkylenepolyamine product.

23. A method of inhibiting corrosion of a corrodible metal material which comprises contacting the metal material with an effective amount of a corrosion inhibiting polyalkylenepolyamine composition comprising a mixture of (a) at least one C-alkyl-ethylene diamine, and (b) at least one di-(C-alkyl)-diethylenetriamine or at least one di(C-alkyl)-piperazine or a mixture thereof; wherein each C-alkyl group on the ethylene diamine, diethylenetriamine and piperazine independently contains from 10 to 28 carbon atoms; and wherein the composition contains greater than 1% of component (b), relative to component (a).

24. The method according to claim 23, wherein each C-alkyl group independently contains from 14 to 22 carbon atoms.

25. The method according to claim 24, wherein each C-alkyl group independently contains from 18 to 22 carbon atoms.

26. The method according to claim 23, wherein the polyalkylenepolyamine composition contains greater than 5% of component (b), relative to component (a).

27. The method according to claim 23, wherein the ratio of component (b) to component (a) is in the range of about 0.05:1 to about 20:1.

28. A method of inhibiting corrosion of a corrodible metal material which comprises contacting the metal material with an effective amount of a corrosion inhibiting composition comprising the polyalkylenepolyamine product obtained by the reaction of a 1,2-dichloroalkane having from 12 to 30 carbon atoms and ammonia.

29. A method of inhibiting corrosion of a corrodible metal material which comprises contacting the metal material with an effective amount of a corrosion inhibiting composition comprising the polyalkylenepolyamine product obtained by the reaction of a 1-epoxyalkane having 12 to 30 carbon atoms and ammonia, in the presence of an amination catalyst and hydrogen.

30. A method of inhibiting corrosion of a corrodible metal material in or around a well through which a corrosive fluid is produced, which comprises contacting the metal material with an effective amount of a corrosion inhibiting polyalkylenepolyamine composition comprising a mixture of (a) at least one C-alkyl-ethylene diamine, and (b) at least one di-(C-alkyl)-diethylenetriamine or at least one di-(C-alkyl)-piperazine or a mixture thereof; wherein each C-alkyl group on the ethylene diamine, diethylenetriamine and piperazine independently contains from 10 to 28 carbon atoms; and wherein the composition contains greater than 1% of component (b), relative to component (a).

31. A method of inhibiting corrosion of a corrodible metal material in or around a well through which a corrosive fluid is produced, which comprises contacting the metal material with an effective amount of a corrosion inhibiting composition comprising the polyalkylenepolyamine product obtained by the reaction of a 1,2-dichloroalkane having from 12 to 30 carbon atoms and ammonia.

32. A method of inhibiting corrosion of a corrodible metal material in or around a well through which a corrosive fluid is produced, which comprises contacting the metal material with an effective amount of a corrosion inhibiting composition comprising the polyalkylenepolyamine product obtained by the reaction of a 1-epoxyalkane having 12 to 30 carbon atoms and ammonia, in the presence of an amination catalyst and hydrogen.

33. A corrosion inhibiting composition comprising the polyalkylenepolyamine composition of claim 1 and one or more dimer/trimer acids.

34. The corrosion inhibiting composition according to claim 33, further comprising one or more ionic or nonionic surfactants and a hydrocarbon solvent.

35. The corrosion inhibiting composition according to claim 34, further comprising one or more alcohols.

36. A corrosion inhibiting composition comprising the composition of claim 6 and one or more dimer/-trimer acids.

37. The corrosion inhibiting composition according to claim 36, further comprising one or more ionic or nonionic surfactants and a hydrocarbon solvent.

38. The corrosion inhibiting composition according to claim 27, further comprising one or more alcohols.

39. A corrosion inhibiting composition comprising the composition of claim 15 and one or more dimer/-trimer acids.

40. The corrosion inhibiting composition according to claim 39, further comprising one or more ionic or nonionic surfactants and a hydrocarbon solvent.

41. The corrosion inhibiting composition according to claim 40, further comprising one or more alcohols.

42. A composition comprising (a) about 15 to 30% of a polyalkylenepolyamine corrosion inhibitor composition comprising a mixture of (i) at least one C-alkyl-ethylene diamine, and (ii) at least one di-(C-alkyl)-diethylenetriamine or at least one di-(C-alkyl)-piperazine or a mixture thereof; wherein each C-alkyl group on the ethylene diamine, diethylenetriamine and piperazine independently contains from 10 to 28 carbon atoms; and wherein the polyalkylenepolyamine composition contains greater than 1% of component (ii), relative to component (i);

(b) about 15 to 30% of a dimer/trimer acid;

(c) about 1 to 10% of a nonionic surfactant;

(d) about 25 to 75% of a hydrocarbon solvent; and (e) about 0 to 5% of an alcohol.

43. A composition comprising (a) about 15 to 30% of a corrosion inhibitor composition comprising the polyalkylenepolyamine product obtained by the reaction of a 1-epoxyalkane having from 12 to 30 carbon atoms and ammonia, in the presence of an amination catalyst and hydrogen;

(b) about 15 to 30% of a dimer/trimer acid;

(c) about 1 to 10% of a nonionic surfactant;

(d) about 25 to 75% of a hydrocarbon solvent; and (e) about 0 to 5% of an alcohol.

44. A composition comprising (a) about 15 to 30% of a corrosion inhibitor composition comprising the polyalkylenepolyamine product obtained by the reaction of a 1,2-dihaloalkane having from 12 to 30 carbon atoms and ammonia;

(b) about 15 to 30% of a dimer/trimer acid;

(c) about 1 to 10% of a nonionic surfactant;

(d) about 25 to 75% of a hydrocarbon solvent; and (e) about 0 to 5% of an alcohol.

45. A composition comprising (a) about 15 to 30% of a corrosion inhibitor composition comprising the polyalkylenepolyamine product obtained by the reaction of a 1,2-dihaloalkane having from 12 to 30 carbon atoms and ammonia and wherein the 1,2-dihaloalkane and ammonia are reacted with about 1 to 50 weight percent of ethylene diamine, a higher polyethylenepolyamine or ethylene dichloride to form the polyalkylenepolyamine product;

(b) about 15 to 30% of a dimer/trimer acid;

(c) about 1 to 10% of a nonionic surfactant;

(d) about 25 to 75% of a hydrocarbon solvent; and (e) about 0 to 5% of an alcohol.

46. A composition comprising (a) about 15 to 30% of a corrosion inhibitor composition comprising the polyalkylenepolyamine product obtained by the reaction of a 1-epoxyalkane having from 12 to 30 carbon atoms and ammonia, in the presence of an amination catalyst and hydrogen, and wherein the 1-epoxyalkane and ammonia are reacted with about 1 to 50 weight percent of ethylene diamine or a higher polyethylenepolyamine to form the polyalkylenepolyamine product;

(b) about 15 to 30% of a dimer/trimer acid;

(c) about 1 to 10% of a nonionic surfactant;

(d) about 25 to 75% of a hydrocarbon solvent; and (e) about 0 to 5% of an alcohol.

* * * * *